US006036189A

United States Patent [19]

Gomez et al.

[11] Patent Number: 6,036,189

[45] Date of Patent: Mar. 14, 2000

[54] GAME WITH VIEWING PANEL HAVING VARIABLE OPTICAL CHARACTERISTICS FOR PRODUCING VIRTUAL IMAGES

[75] Inventors: George A. Gomez, Evanston; Patrick M. Lawlor, Marengo, both of Ill.; Thomas W. Uban, Valparaiso, Ind.

[73] Assignee: Williams Electronics Games, Inc., Chicago, Ill.

[21] Appl. No.: 09/231,401

[22] Filed: Jan. 14, 1999

Related U.S. Application Data

[63] Continuation-in-part of application No. 09/081,146, May 19, 1998.

[51] Int. Cl.[7] ..... A63D 3/00

[52] U.S. Cl. ..... 273/118 R; 463/34; 273/118 A; 273/127 R

[58] Field of Search ..... 273/118 R, 118 A, 273/121 A, 122 A, 124 A, 127, 108, 106.1; 463/30, 31, 32, 33, 34, 46

[56] References Cited

U.S. PATENT DOCUMENTS

| | | |
|---|---|---|
| 2,468,452 | 4/1949 | Leverenz . |
| 2,845,618 | 7/1958 | Huffman . |
| 3,549,803 | 12/1970 | Becht et al. . |
| 4,093,347 | 6/1978 | La Russa . |
| 4,189,145 | 2/1980 | Stubben et al. . |
| 4,305,095 | 12/1981 | Dallas . |
| 4,306,768 | 12/1981 | Egging . |
| 4,367,876 | 1/1983 | Kotoyori . |
| 4,371,164 | 2/1983 | Halliburton . |
| 4,375,286 | 3/1983 | Seitz et al. . |
| 4,421,317 | 12/1983 | Hector et al. . |
| 4,448,417 | 5/1984 | Clark et al. . |
| 4,490,745 | 12/1984 | Erickson et al. . |
| 4,736,214 | 4/1988 | Rogers . |
| 4,853,764 | 8/1989 | Sutter . |
| 5,190,286 | 3/1993 | Watanabe et al. . |
| 5,221,083 | 6/1993 | Dote . |
| 5,316,303 | 5/1994 | Trudeau et al. . |
| 5,327,284 | 7/1994 | Kuester . |
| 5,351,966 | 10/1994 | Tohyama et al. . |
| 5,417,422 | 5/1995 | Hansen . |
| 5,418,579 | 5/1995 | Jamieson et al. . |
| 5,421,589 | 6/1995 | Monroe ..... 463/34 |
| 5,553,864 | 9/1996 | Sitrick . |
| 5,669,685 | 9/1997 | Kotani et al. . |
| 5,685,625 | 11/1997 | Beaver . |

FOREIGN PATENT DOCUMENTS

| | | |
|---|---|---|
| 3023878 | 1/1982 | Germany . |
| 2 124 505 | 2/1984 | United Kingdom . |
| WO 8401908 | 5/1984 | WIPO . |

OTHER PUBLICATIONS

Blaster™ brochure, Williams Electronics Games, Inc., Chicago, Illinois, 1983.

Description and drawings of 10 Pin Deluxe game, Williams Electronics Games, Inc., Chicago, Illinois, date unknown.

Description and photograph of Namco redemption game, Namco, Ltd., Tokyo, Japan, date unknown.

Brochure for 10 Pin Deluxe Game, Midway Games Inc., Chicago, Illinois, date unknown.

*Primary Examiner*—Jessica J. Harrison

*Attorney, Agent, or Firm*—Arnold White & Durkee

[57] ABSTRACT

A game which comprises a plurality of play devices and a panel for prohibiting access of a player to the plurality of play devices. The panel includes at least two optically distinct portions. A first optically distinct portion is substantially transparent for viewing at least one of the play devices and a second optically distinct portion is partially transparent for viewing at least another of the plurality of the play devices and partially reflective for reflecting a virtual image to be viewed by the player. The second optically distinct portion having a higher reflectivity than the first optically distinct portion.

56 Claims, 10 Drawing Sheets

GAME WITH VIEWING PANEL HAVING VARIABLE OPTICAL CHARACTERISTICS FOR PRODUCING VIRTUAL IMAGES

RELATED APPLICATIONS

This application is a continuation-in-part application of Ser. No. 09/081,146, filed May 19, 1998, pending. Additionally, this application is filed concurrently with the following closely related applications: U.S. application Ser. No. 09/274,793, entitled "Method and Kit for Retrofitting a Pinball Machine;" U.S. application Ser. No. 09/231,092, entitled "Lock-Down Bar Release System for a Pinball Machine;" U.S. application Ser. No. 09/232,250 entitled "Electronic Component Board Mounting System;" U.S. application Ser. No. 09/231,404 entitled "Mounting Mechanism for a Playfield of a Pinball Machine;" U.S. application Ser. No. 09/232,249 entitled "Playfield Assembly for a Pinball Machine;" U.S. application 09/231,403 entitled "Method of Displaying Video Images Projected from a Video Display of a Pinball Machine;" U.S. application Ser. No. 09/232,251 entitled "Method of Modifying Electronics Contained in a Controller Box of a Pinball Machine;" U.S. application Ser. No. 09/232,248 entitled "Method of Replacing a Playfield of a Pinball Machine;" U.S. application Ser. No. 09/231,402 entitled "Ball Block Assembly for a Pinball Machine;" U.S. application Ser. No. 09/232,247 entitled "Method of Identifying the Condition of a Lamp or Fuse of a Pinball Machine," all of which are herein incorporated by reference in their entireties.

FIELD OF THE INVENTION

This invention relates generally to games, and more particularly, to a game having a viewing panel with both reflective and transmissive qualities for producing virtual images at selectable positions within the game.

BACKGROUND OF THE INVENTION

Amusement games such as pinball games and video games are often found together in arcades and other amusement establishments. The designers of these games strive to constantly provide innovations to continue to attract interest, both for attracting new players and for retaining the interest of present players.

In pinball games, generally speaking, a playfield upon which a rolling ball is supported is located in a generally horizontally disposed cabinet. The playfield is usually tilted or inclined at a slight angle to cause the ball to roll toward the end or bottom of the playfield, where the skilled player may use flippers to attempt to propel the ball back into to the playfield area. A display for pinball games usually consists of an alphanumeric display for showing the score of one or more players. This display is usually mounted in a backbox which is mounted above the cabinet and generally at an end opposite the player position. The display may utilize electromechanical alphanumeric display elements or electrical or electronic illuminated display elements such as neon tubes or is LEDs or the like. In some cases, so-called dot matrix display elements have been used to generate alphanumeric displays, and other somewhat limited visual displays.

Video games generally utilize a video display on a cathode ray tube (CRT) or equivalent device to, in effect, provide the "playfield" for the game. This, in effect, replaces the mechanical playfield and rolling ball of the pinball game. However, many types of game action can be displayed in video games.

Thus, generally speaking, video games have heretofore not provided an opportunity of using a playfield with a rolling ball and other mechanical or electromechanical elements with which the ball interacts in the playfield. On the other hand, pinball games have not heretofore provided the range and complexity of changeable visual effects or displays comparable with those available in video games. Moreover, the play action in pinball games has heretofore been restricted to interaction of the rolling ball with various playfield devices or play features in the playfield. That is, there has been no interaction of the ball with video generated images or features.

U.S. Pat. No. 4,375,286 to Seitz et al. incorporates a CRT screen mounted in the playfield to, in effect, incorporate a video game into the same cabinet with the pinball game. In the Seitz et al. patent, the pinball game and video game are described as essentially separate games. However, there is some provision for interaction between the video and pinball games, to the extent that achieving certain conditions during one or the other of the games might enable or initiate play in the other of the two games.

U.S. Pat. No. 4,367,876 to Kotoyori is directed to a pinball machine which has a CRT display unit taking up a portion of the backbox for indicating scores of the players. The Kotoyori patent also provides for multiple player scores to be displayed, with the score of the player presently playing preferably being displayed in a larger size than the scores of the other players. This display may also identify each of the displayed scores with a player by displaying such indications as "first player," "second player,"etc. adjacent the scores.

U.S. Pat. No. 5,316,303 to Trudeau et al. is directed to a pinball game having a holographic display of a fixed image which is displayed through a transparent panel in the playfield. A light illuminating the image may be moved, and the plate upon which the image is mounted may also be flexed or otherwise moved, to cause the image to appear to the player to move from left to right and/or toward and away from the player.

SUMMARY OF THE INVENTION

In accordance with one aspect of the invention, a game incorporates both play devices and a video display. The video display is used to create virtual images in association with the play devices. The projected virtual image is interactive with the play devices of the game in that the virtual images can be changed in response to the certain play devices being acted upon by the player which, in the case of a typical pinball game, occurs when the player propels the rolling ball into play features such as a bumper or a target. The video images are stored in a memory device and are selected for display on the video display by a game controller.

To provide the interaction of the virtual image with the playfield, a panel that is used to prohibit access of a player to the playfield includes at least two optically distinct portions. A first optically distinct portion is substantially transparent for viewing at least one of the play devices. A second optically distinct portion is partially transparent for viewing at least another of the plurality of the play devices and partially reflective for creating a virtual image to be viewed by the player. The second optically distinct portion has a higher reflectivity than the first optically distinct portion.

The images are projected from the video display onto the panel. The reflective portion of the panel reflects the image such that it is viewed by the player as a virtual image adjacent to the play devices.

DESCRIPTION OF ILLUSTRATIVE EMBODIMENTS

Figure 1:
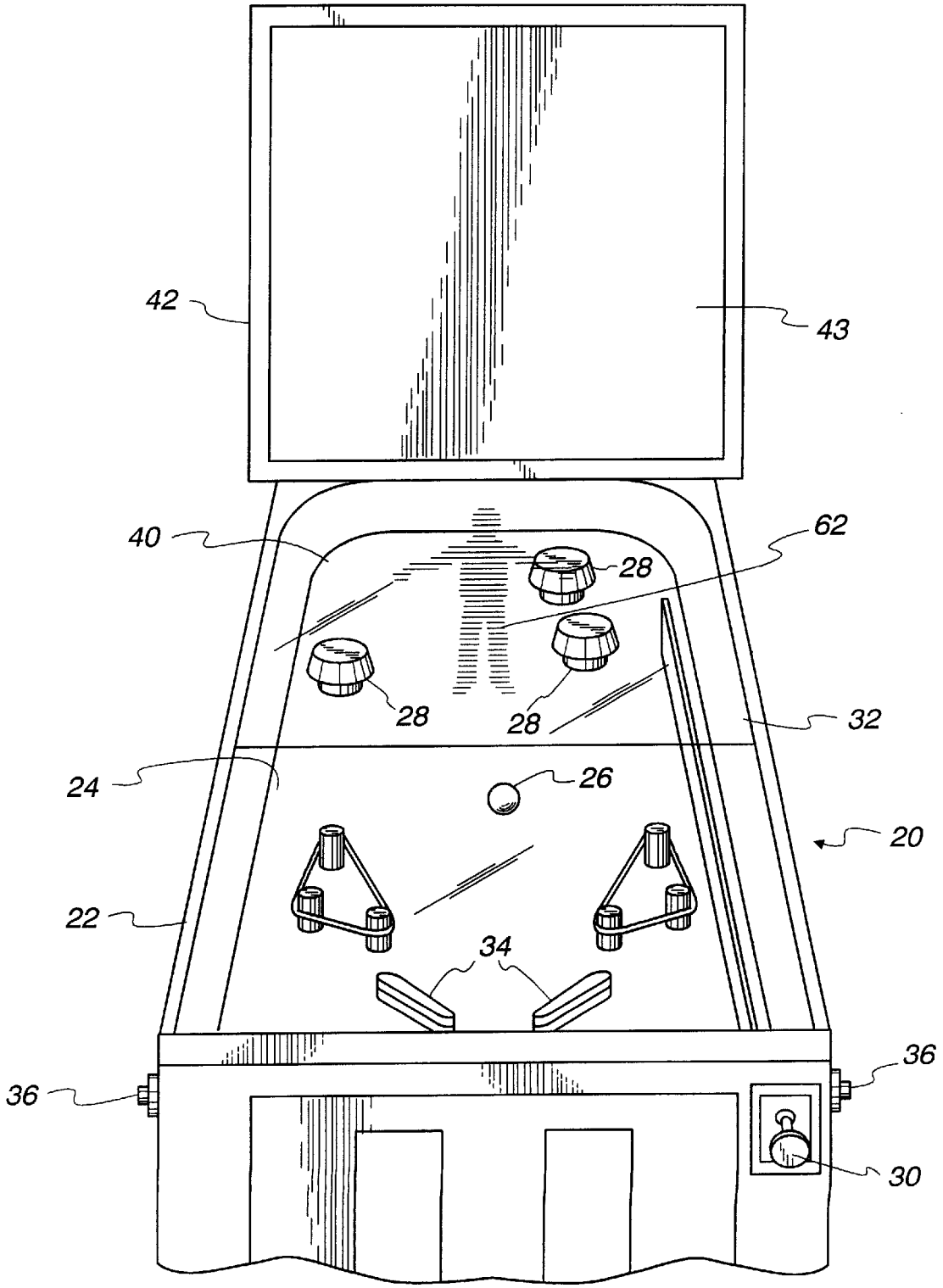
FIG. 1 is a front perspective view of amusement game in accordance with the invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Figure 2:
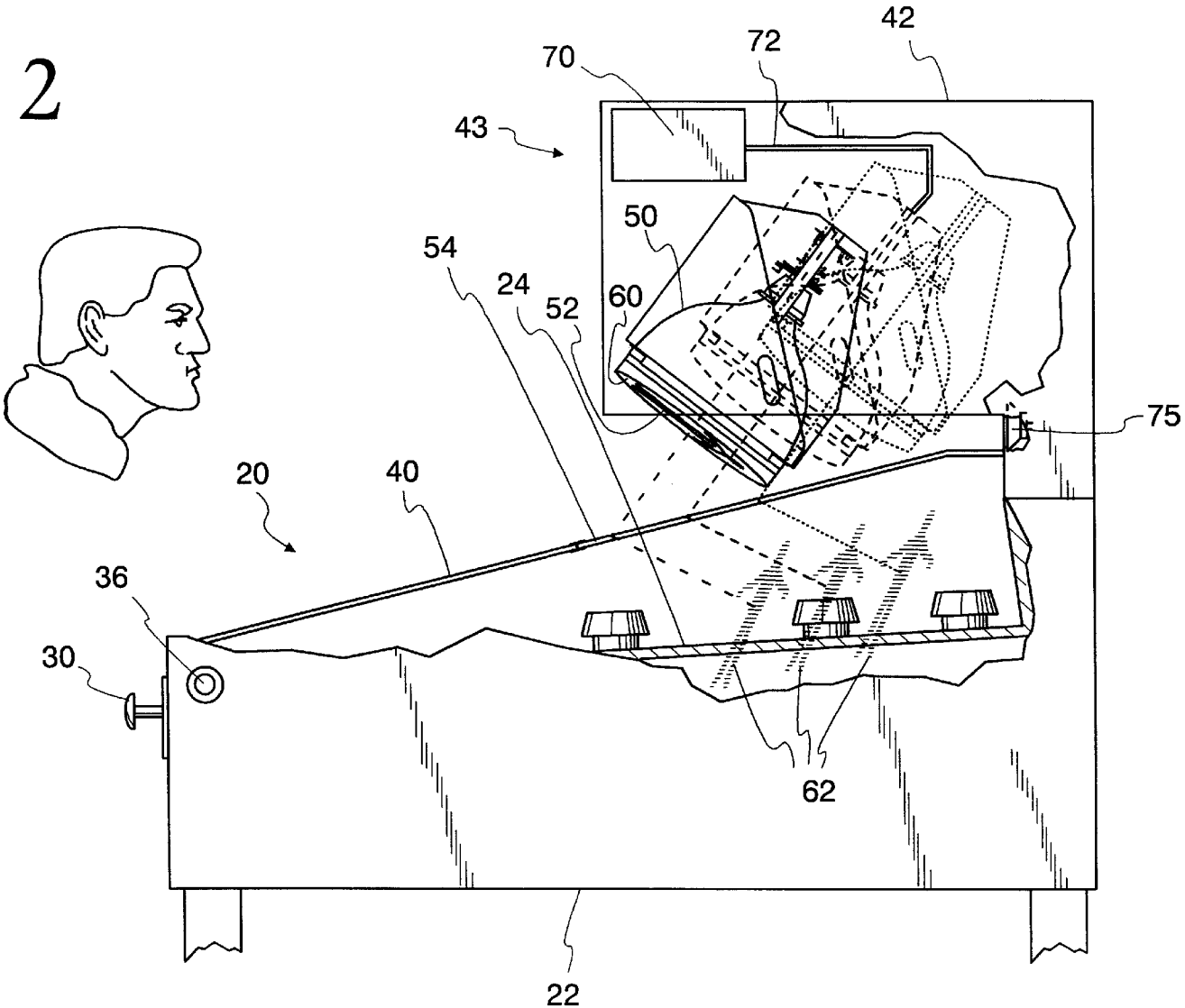
FIG. 2 is a side elevation, partially broken away and partially in section, of the amusement game of FIG. 1.

Referring now to the drawings, and initially to FIGS. 1 and 2, there is shown an amusement game in accordance with the present invention, and designated generally by the reference numeral 20. The amusement game 20 includes a cabinet 22 which houses a playing field or playfield 24 which may be inclined. The playing field 24 supports a game piece such as a rolling ball 26 and has a plurality of playfield features and devices. These features and devices may take a number of forms and some relatively simplified play features are indicated generally by reference numeral 28 in FIG. 1. The ball 26 may be initially introduced into the playfield 24 by shooting the ball 26 with a plunger element 30 up an alley 32.

If the playfield 24 is inclined, as shown in FIG. 2, the ball tends to roll back generally in the direction of a pair of flippers 34 located at a bottom end part of the playfield 24. The flippers 34, which are activated by buttons 36 on the sides of the cabinet, are used by the skilled player to propel the ball back into the play area of the playfield 24. The playfield devices and features 28 may include a number of elements such as bumpers (as shown) as well as other elements not shown in FIG. 1. These other elements may include, without limitation, targets, various lights or other illumination devices, three-dimensional objects or figures, targets which are fixed or movable, and so-called pop-up targets which are mounted generally below the surface of the playfield and may be selectively extended or retracted relative to the playfield. Other elements not shown in FIG. 1 may also be used, such as lanes, ramps, elements which are capable of selectively holding and releasing the ball, etc. Other types of playfield features or devices might be utilized without departing from the invention, the foregoing being by way of example only.

The playfield 24 is generally covered by a transparent panel 40 of glass or plastic through which a player may view the playfield 24 and its contents. A backbox 42 is mounted generally above the playfield and usually at an end thereof opposite a player station which is adjacent the location of the flippers 34 and plunger 30. Flipper control buttons 36 are also usually provided at the sides of the cabinet 22 for controlling the operation of the flippers 34.

The above-described features are usually found in various pinball games. Referring to FIG. 2, departing from convention, the backbox 42 mounts a cathode ray tube (CRT) 50 or functionally equivalent structure such as one or more rows or a grid of LED's, or a flat screen video display device, or a video projector. The CRT 50 is mounted such that its screen 52 is directed generally in the direction of the playfield 24, that is, generally in the vertically downward orientation as indicated in FIG. 2. Cooperatively, a portion 54 of the transparent panel 40 which is aligned with the image surface or screen 52 of the CRT 50 thereabove is constructed of material that has both transparent and reflective properties. For example, the panel portion 54 may be constructed of tinted glass or plastic. Advantageously, the relative orientations or angular offsets of the CRT screen 52 and the panel 54 are such that an image 60 appearing on the screen 52 will be projected as a virtual image 62 into the cabinet 22 in association with the playfield 24. In the illustrated embodiment, these relative angles and positions of the CRT screen 52 and the panel 54 are such that the virtual image appears to be projecting in a generally vertical direction intersecting with or projecting out of the playfield 24 as indicated in FIGS. 1 and 2. FIG. 2 shows three different positions of the CRT 50 and corresponding positions of the virtual image 62, to illustrate how the position of the virtual image may be moved back and forth relative to the playfield. It will be appreciated that the angular orientation of the virtual image 62 relative to the playfield 24 may also be varied as desired by varying the angle of the CRT or other device. The same considerations of spacing, angles and relative positions apply, in order to obtain a virtual image at a desired position, where the image is provided by apparatus other than or in addition to a CRT, such as a video projector, rows or grids of LED's, etc.

The image 62 projected into the playfield 24 may be a two dimensional image or a three-dimensional image, if desired, such that the virtual image 62 may have components which appear to be in a single plane intersecting the playfield or which appear to be in any number of positions behind the plane of the image 62 shown in FIGS. 1 and 2. Additional images in other positions, including in front of this plane, could be provided by a second image producing apparatus (such as a second CRT, a row or grid of LED's, a flat screen device, or a video projector) mounted adjacent the CRT 50, and located relative to the surface 54 to produce the added or second image at the desired location. Moreover, the virtual image 62 may include a virtual image of a game piece or ball. In the same manner, the virtual image 62 may include a playfield or playfield features.

The virtual image 62 projected into the playfield from the CRT 50 may include fixed or moving images, video displays, scoring and/or instructional displays, or a combination of such images and displays, as desired. A source of data or information for forming these images on the CRT screen 52 may be a computer or processor or controller device 70 mounted in the backbox 42 and one or more associated storage devices or sources from which the processor may select images (and audio effects information, if desired) for display (or reproduction). A cable 72 couples the controller 70 to the CRT 50. In connection with the processor or controller 70, various storage devices or other sources of images (and, if desired, corresponding audio information) may be used including, but not limited to, ROM, RAM and other forms of solid state memory device, either as a part of, or operatively coupled with the processor 70, as well as magnetic disk, optical disk, video disk, video tape, and the like and corresponding player units operatively coupled with the processor or controller 70. The images may also be imported from other sources by use of a modem or other means operatively connected with the processor 70, such as broadcast TV or satellite TV tuners, a cable TV hookup, or a proprietary cable feed, among other things. Any other source of video image information (and, if desired, corresponding audio information) might be utilized without departing from the invention. An audio or sound reproduction device such as a loudspeaker 75 may be provided for reproducing any desired audio effects.

In accordance with another feature of the invention, the image selected and projected by the CRT 50 (and, if desired, the production of audio effects) are interactive with the elements of the game, that is, with the game piece or ball, and/or with the devices and features on the playfield. For example, the position of the ball 26 or other game piece may be sensed in various ways as further described below, such that the image may be selected, changed and varied interactively with the ongoing play of the game.

A number of examples of selecting and projecting an image (and, if desired, producing audio effects) interactively with the play of the game are shown in FIGS. 3–9 and described below. It will be understood that these examples are given only for purposes of illustration and description and are not in any way to be taken as limiting the scope of the invention.

Figure 3:
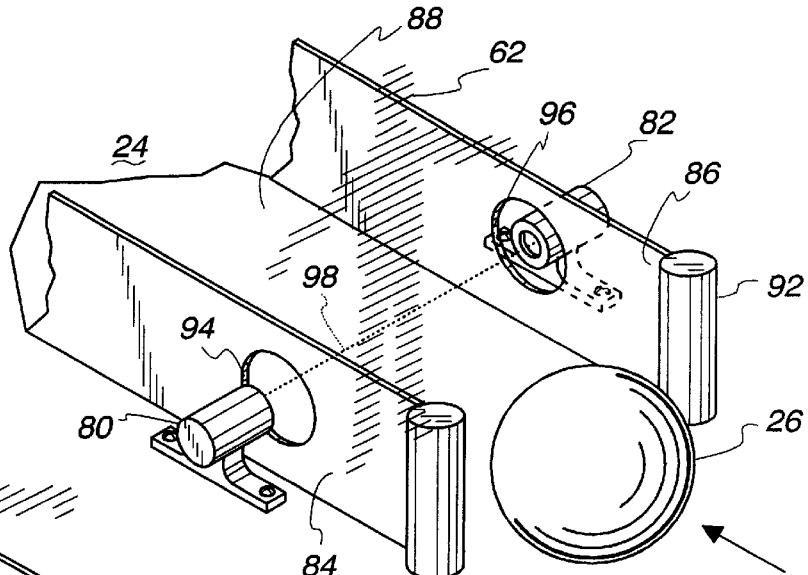
FIG. 3 is an enlarged fragmentary perspective view showing further details of the game in accordance with one embodiment of the invention.

Referring now to the remaining figures of drawings, and initially to FIG. 3, there is illustrated one example of a sensor arrangement for sensing the presence or absence of the ball 26 at a given location on the playfield and for producing a corresponding sensor signal. The processor or controller 70 is responsive to this sensor signal for selecting the content of the image projected as a virtual image 62 into the playfield area. In FIG. 3, the sensor takes the form of a light emitting device 80 and a light sensitive device 82 which are mounted to either side of, and in alignment with through openings 94 and 96, in a pair of elongate upright ball guide surfaces or walls 84, 86 which generally define a lane 88 therebetween. Respective posts 90 and 92 may support the respective guides 84 and 86 and attach to the playfield. In the illustrated embodiment, the light emitting device 80 is mounted directly to the surface of the playfield 24 and may be an infrared emitting device (IFR) such as a light emitting diode (LED). The light sensitive device 82 is also shown mounted to the playfield surface, and may be a photosensor such as a photosensitive diode or transistor. The photosensor is preferably mounted opposite and in alignment with the light emitting device 80, the openings 94, 96 being in alignment with each other and with the respective light emitting and light sensitive devices 80 and 82.

In operation, as the ball 26 passes up the lane 88 and breaks the light beam diagramatically indicated at reference numeral 98 between the light emitting device 80 and photosensitive device 82, a signal will be given to the controller for making some corresponding change or variation in the image 62. A corresponding audio effect may also be initiated by this interruption of the light beam 98 by the ball 26. The projected image 62 is shown in FIG. 3 located in the lane 88 generally in the plane of the beam 98; however, the image 62 may be located elsewhere without departing from the invention. Indeed, the image may have several components, only one of which is located as shown in FIG. 3. The same is true of the images 62 shown in each of FIGS. 4–7. The ball guide walls 84 and 86 form a convenient lane, such that a number of such lanes might be utilized in the game, with the passage of a ball into each lane triggering a different visual and audio (if desired) effect. Other segments or portions of the playfield might be defined by other arrangements of sensors, lanes, and the like in with different fashions without departing from the invention.

Figure 4:
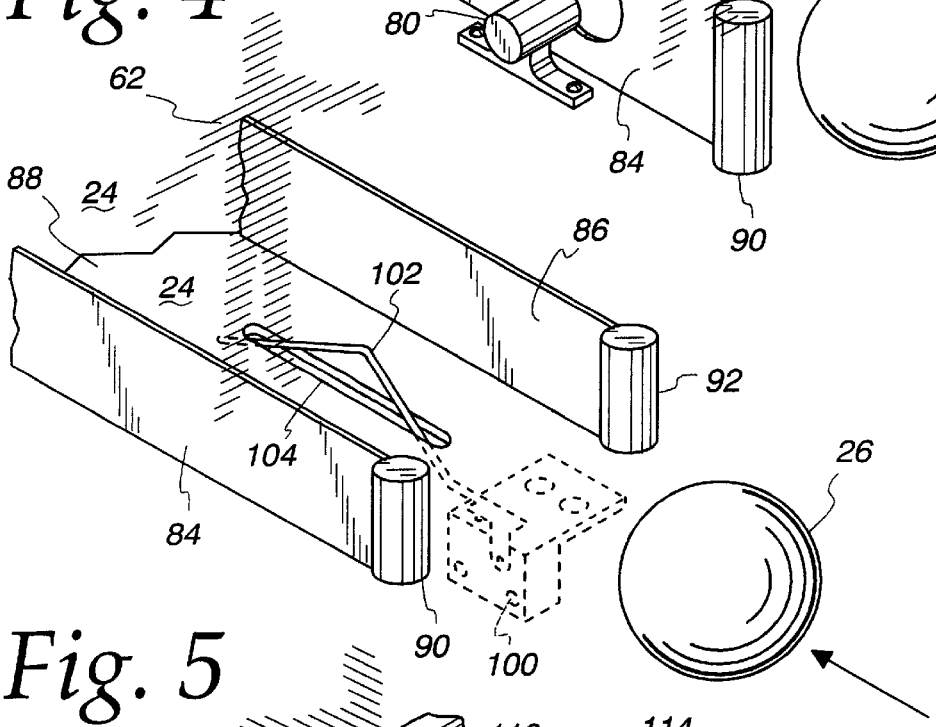
FIG. 4 is an enlarged fragmentary perspective view showing further details of the game in accordance with another embodiment of the invention.

Referring to FIG. 4, a so-called rollover microswitch is positioned in the lane 88 which is formed by similar ball guides 84, 86 supported at end posts 90 and 92 in the same fashion described above with reference to FIG. 3. Microswitch 100 may include a formed wire 102 which projects upwardly into the play area through a slot 104 provided for this purpose in the surface of the playfield 24. The image 62 may be projected generally in a plane which intersects the wire 102 of the switch 100. Thus, when the ball 26 passes over and deflects the wire 102, the switch 100 provides a useable signal to the processor 70 to trigger a corresponding visual and audio (if desired) effect, in the same manner described above with reference to FIG. 3.

Figure 5:
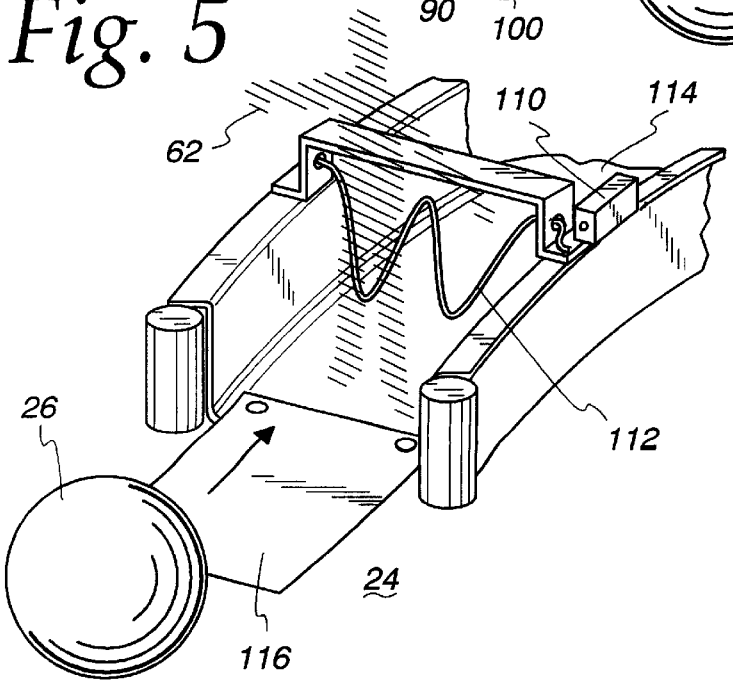
FIG. 5 is an enlarged fragmentary perspective view showing further details of the game in accordance with another embodiment of the invention.

FIG. 5 shows a ball position sensor in the form of a rollunder switch or gate 110 which has a formed wire or actuator member 112 which extends into a lane or ramp 114. The lane or ramp 114 as illustrated in FIG. 5 is an elongated trough-like ramp 114 which begins at the surface of the playfield and is inclined upwardly and away from the surface point of the playfield 24. An entrance apron 116 extends from the front part of the ramp 114 to provide a smooth entrance for the ball 26. When the ball 26 reaches the wire actuator 112 of the microswitch 110, a signal will be given to the processor 70 which may cause the virtual image 62 to be varied or some other visual and audio (if desired) effects to be triggered or initiated. Again, the visual image 62 is indicated in FIG. 5 generally in the plane of the undeflected actuator 112, but may be in other locations or have other components if desired.

Figure 6:
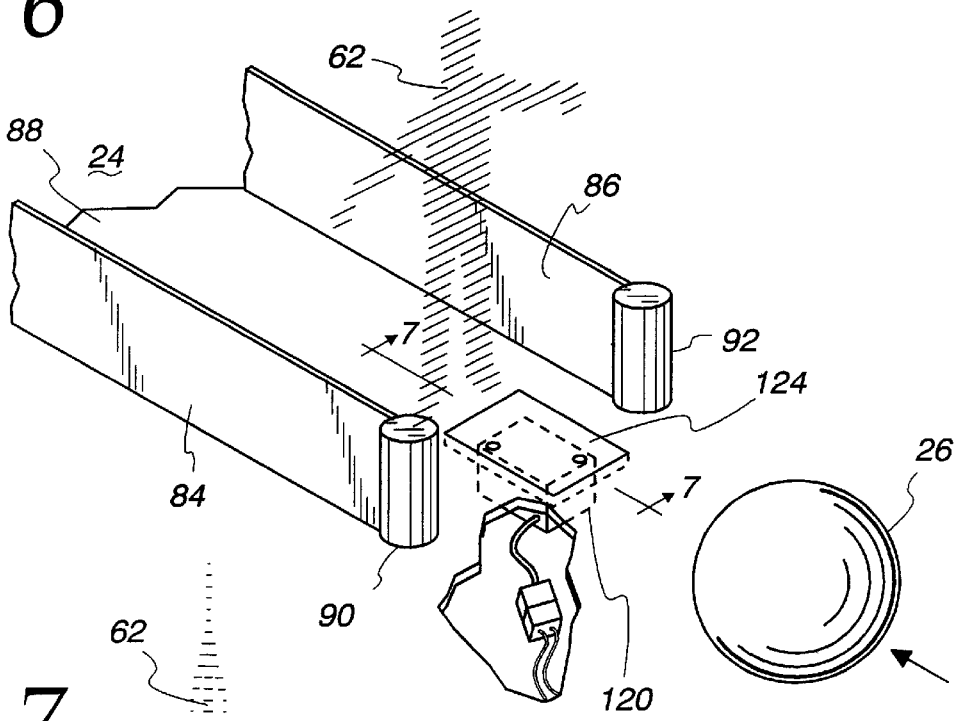
FIG. 6 is an enlarged fragmentary perspective view showing further details of the game in accordance with another embodiment of the invention.
Figure 7:
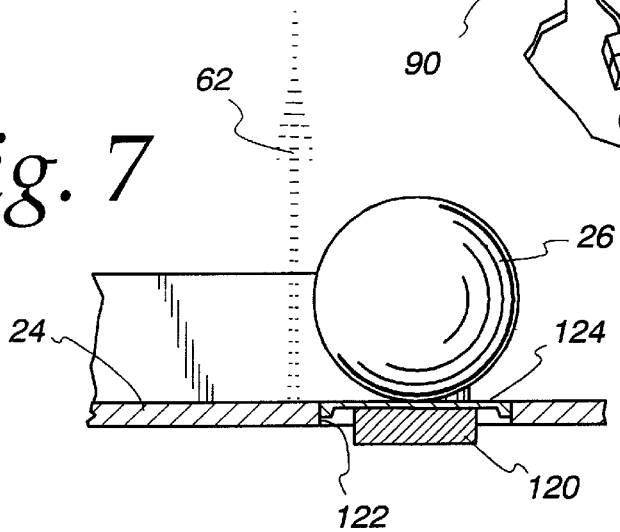
FIG. 7 is a partial side elevation, partially in section, showing further details of the embodiment of FIG. 6.

Referring to FIGS. 6 and 7, yet another form of sensing device or sensor in the form of a reed switch or pressure sensitive switch 120 is illustrated. The reed switch 120 is mounted just below the surface of the playfield 24 and preferably in a recess 122. A relatively thin panel such as a plastic insert 124 may cover the recess or opening 122 in the playfield within which the switch 120 is mounted. FIG. 6 illustrates the switch in connection with similar guides 84, 86 which define a lane 88 in the playfield 24. This switch 120, as well as the switches of the embodiments of FIGS. 3 and 4 could also be mounted, if desired, in connection with the ramp such as the ramp 114 shown in FIG. 5, or could be mounted in some position on the playfield without a corresponding ramp or lane being defined, if desired.

Figure 8:
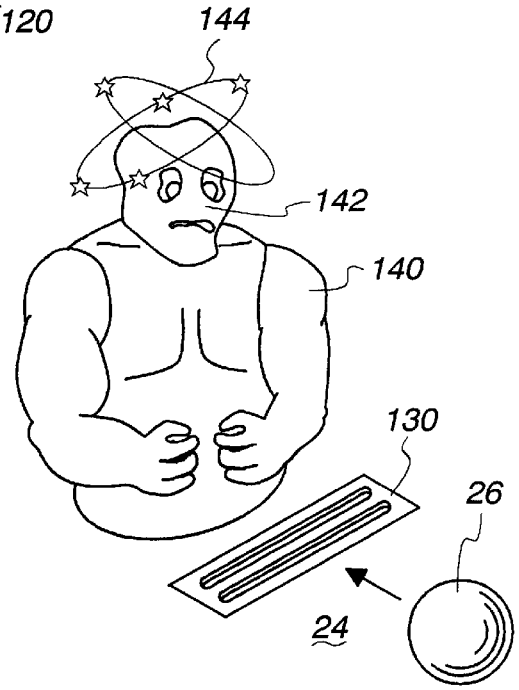
FIG. 8 is a fragmentary perspective view showing further details of the game in accordance with another embodiment of the invention.

Referring briefly to FIG. 8, other types of sensors might similarly be mounted just beneath the surface of the playfield 24, such as an eddy current sensor 130. These various forms of sensors shown in the embodiments of FIGS. 3–7 may be utilized in connection with other playfield features or devices without departing from the invention. For example, in FIG. 8 a three-dimensional object or FIG. 140 comprises one such playfield feature or device. The FIG. 140 may be mounted in a fixed location relative to the sensor 130, such that when the ball 26 is sensed passing by the sensor 130 visual activity and (if desired) audio effects are triggered in connection with the FIG. 140. This may include mechanical movement of one or more portions of the FIG. 140 as well as the projection of a virtual image onto or adjacent to the FIG. 140. As illustrated in FIG. 8, the three-dimensional FIG. 140 has a face 142 upon which different facial features or expressions may be projected as a virtual video image. Thus, the facial features may noticeably change as the ball strikes the FIG. 140 (as sensed by the sensor 130), for example. Additional virtual video effects may also appear in a three-dimensional (3-D) image form, such as stars circling the head of the FIG. 140, as indicated generally at reference numeral 144 in FIG. 8. The FIG. 140 could alternately be a two-dimensional figure and/or partially formed as a virtual visual image, without departing from the invention.

Figure 9:
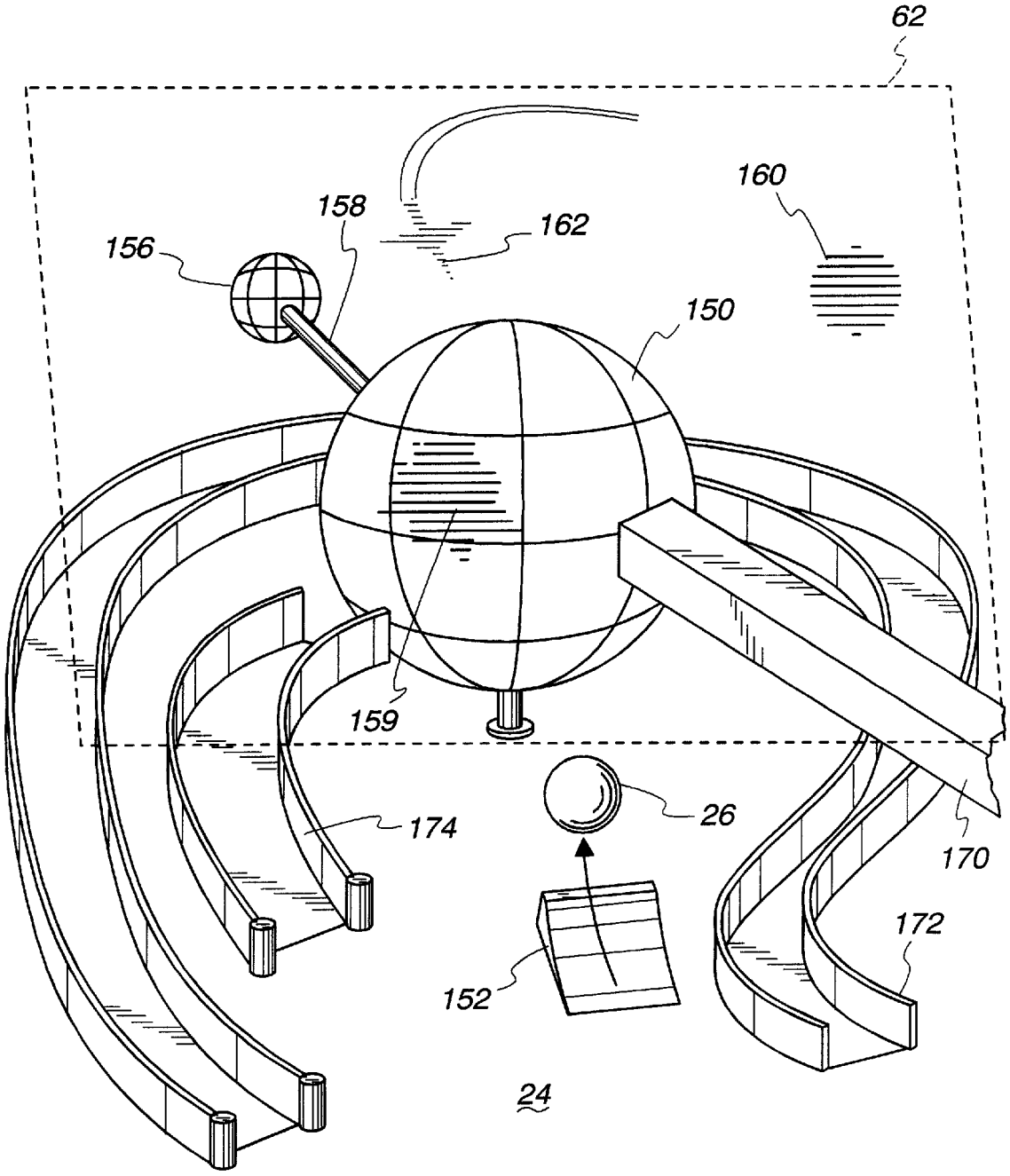
FIG. 9 is a partial perspective view showing further details of still another embodiment of the invention.

Referring also to FIG. 9, various combinations of ramps and lanes provided with various sensing devices or switches, for example, of the types illustrated in FIGS. 3–8, might be utilized within the scope of the invention. Moreover, various combinations of two- or three-dimensional objects or figures in the playing field and virtual video effects projected into the playing field onto or in association with or adjacent to the three-dimensional objects may be utilized. Thus, for example, FIG. 9 illustrates a playfield 24 which includes a three-dimensional object in the form of a three-dimensional "planet" 150 which may be a molded plastic object. One or more sensor devices (not shown) may be used in connection with the three-dimensional object 150 to trigger additional projected images, such as an "explosion" 159 projected upon the surface of the planet 150. In the embodiment shown, a ramp 152 "launches" the ball 26 at the planet to cause the "explosion" 159 to be displayed.

The processor or controller 70 can be programmed to take into account the relative position and speed of the ball (for example by measuring the time during which the beam of an optical sensor is broken) and implement suitable timing or time delays in initiating (and/or selecting) the responsive video image (and, if desired, audio effects), such as the "explosion" 159 on the planet 150.

Other projected images, or three-dimensional objects or various combinations thereof might be utilized in connection with the object or planet 150. For example, a secondary orbiting planet or satellite 156 might be a three-dimensional object which is physically connected with the planet or object 150, for example by a connecting element 158. Other satellites or other planets or similar elements might be a part of the virtual projected video image 62, for example, the virtual image planet 160 is shown in FIG. 9. Other virtual images, for example a spacecraft 162 might also be projected as a part of the image 62 in connection with the planet 150. The various portions 159, 160, 162 of the projected image 62 may appear in a single image plane or in multiple planes, or as 3D images.

The appearance or disappearance, movements, etc. of all of the projected image elements such as the explosion 159, the planet 160 and the spacecraft 162 might be in accordance with a preprogrammed sequence, which might be either a fixed sequence or triggered or run in connection with the sensed position of the ball 26 at various times during the play of the game. FIG. 9 also illustrates a number of additional playfield devices and features, such as various combinations of ramps and lanes 170, 172 and 174 in connection with the already described playfield features.

Figure 10:
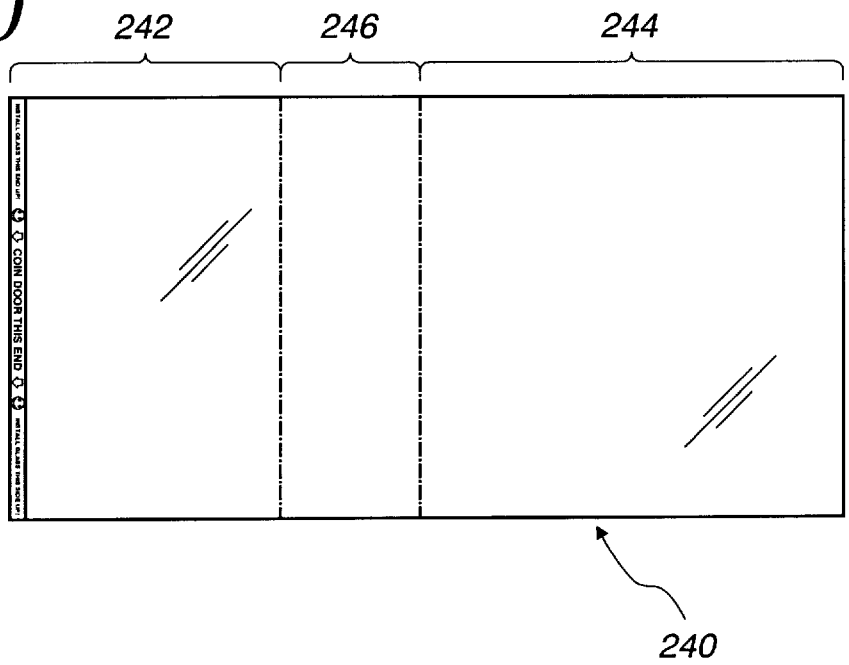
FIG. 10 is a top view of a panel that has three optically distinct portions.
Figure 11:
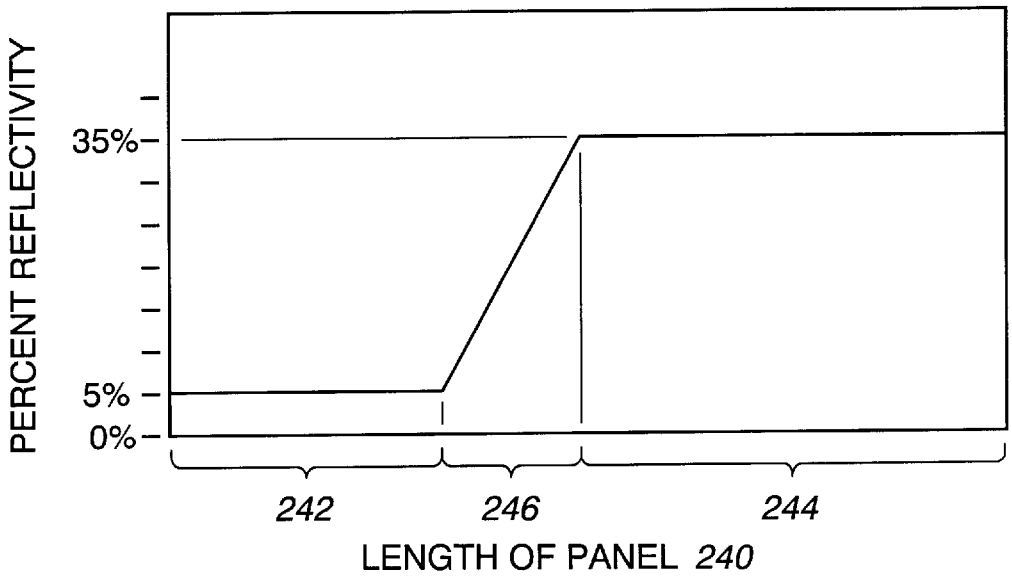
FIG. 11 is a graph showing the reflectivity of the panel in FIG. 10 as a function of length.

Referring now to FIGS. 10–11, an alternative panel 240 is illustrated which can be used in place of the panel 40 described above. The panel 240 includes a first portion 242, a second portion 244, and a third portion 246 lying between the first and second portions 242, 244. The second portion 244 is similar to the portion 54 of the panel 40 described above in that it has enhanced reflective properties.

Specifically, the second portion 244 has a reflectivity in the range from about 30% to about 40%, and preferably about 35%, and has a transmittance in the range from about 25% to about 35%, and preferably about 30%. Since the panel 240 is preferably made of glass, the first portion 242 has an inherent reflectivity of about 5%. This inherent reflectivity, however, can range from about 5% to about 15%. The relatively low reflectivity in the first portion 242 allows the player to easily visualize the playfield 24 and its play features 28 positioned therebelow. The higher reflectivity in the second portion 244 allows the player to still visualize the playfield 24 and its play features 28, but it also reflects the image on the screen 52 of the CRT 50 that is to be viewed by the player as a virtual image.

The third portion 246 has a reflectivity that is between the reflectivity of the first and second portions 242, 244. Most preferably, as shown in FIG. 11, the reflectivity of the third portion 246 gradually changes in a linear manner as a function of the length of the panel 240. Thus, a portion of the third portion 246 adjacent to the first portion 242 has a reflectivity that is similar to that of the first portion 242. Likewise, a portion of the third portion 246 adjacent to the second portion 244 has a reflectivity that is similar to that of the second portion 244. Because the reflectivity of the third portion 246 gradually changes, the player is less likely to visualize the distinct optical characteristics of the first portion 242 and the second portion 244. In a preferred embodiment, the length of the first portion 242 is about 14 inches, the length of the third portion 246 is about 7 inches, and the length of the second portion 244 is about 21 inches. Thus, the reflectivity in the third portion 246 changes at a rate of about 4% to 5% per inch when the reflectivity of the first portion 242 is about 5% and the reflectivity of the second portion is about 35%. The thickness of the panel 240 is about 0.2 inch.

Figure 12A:
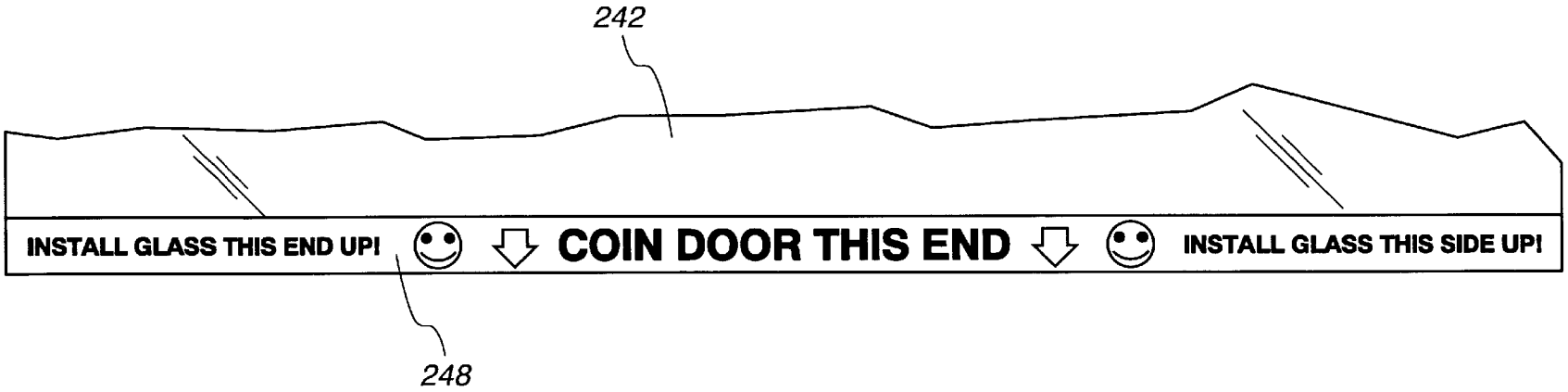
FIGS. 12A and 12B illustrate markings placed on the panel to ensure that the panel is placed on the machine in the correct orientation.
Figure 12B:
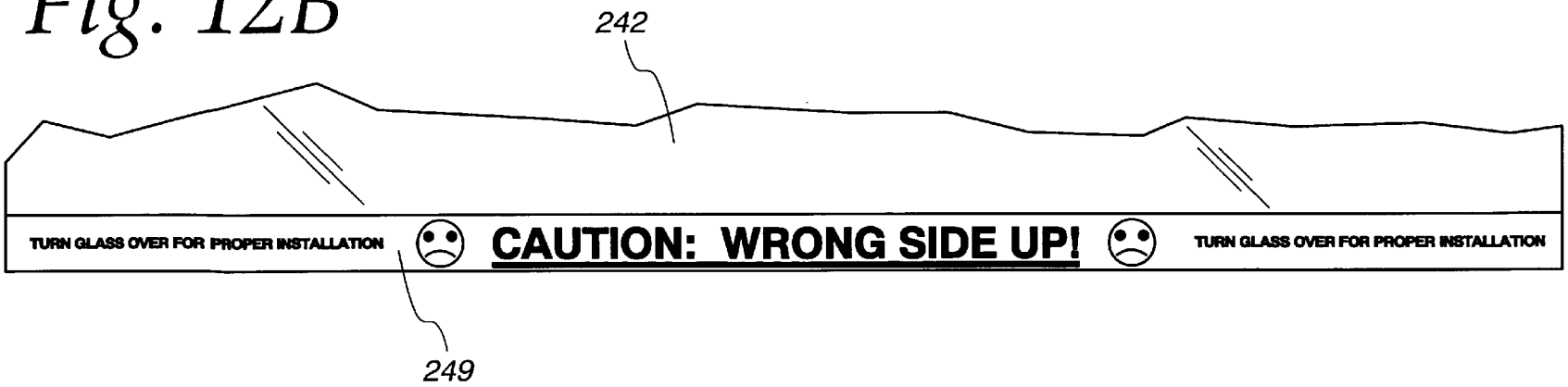

In a preferred embodiment, the panel 240 is a unitary, planar piece of glass that is coated with a material, such as silver, to produce the desired reflectivity at the second portion 244 and third portion 246. The coating is applied to the outer surface of the panel 240 such that the reflective coating is exposed to the player. Thus, the image that is created through the reflection at the top surface is more defined than if it were created by transmitting through the panel 240 and then reflecting from a coating on the lower surface of the panel 240 facing the playfield 24. While it is preferred to have the reflective coating on the upper surface of the panel 240, the system can still function when the coating is located on the lower surface of the panel 240. To ensure that the panel 240 is properly installed, the end of the first portion 242 of the panel 240 has a notice printed on either side as shown in FIGS. 12A and 12B. In FIG. 12A, a notice 248 indicates that the panel 240 is correctly installed (i.e. the coating is on the upper surface exposed to the player). In FIG. 12B, the notice 249 indicates that the panel 240 has been improperly installed and should be removed and properly reinstalled.

Figure 13:
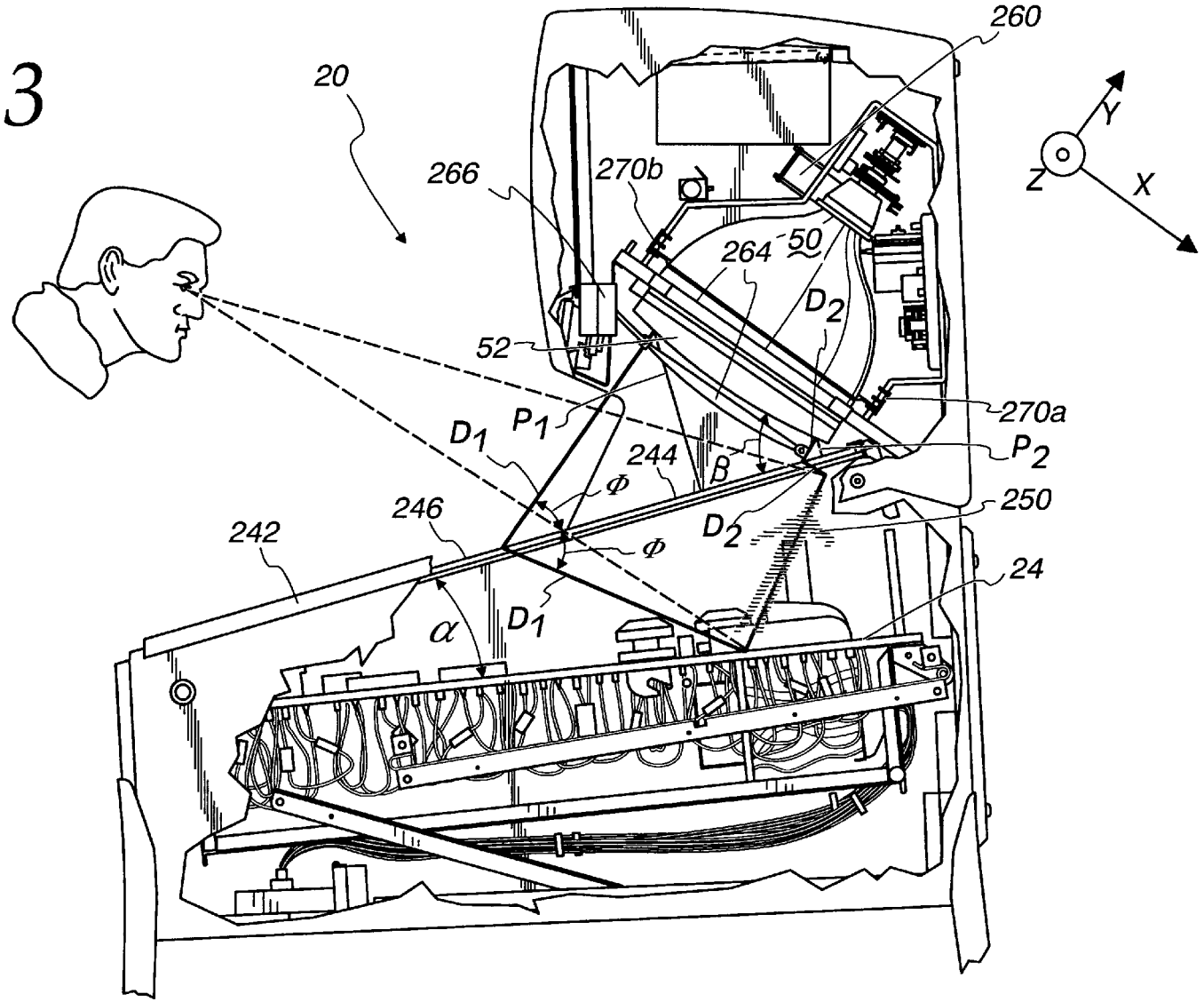
FIG. 13 is a side view of a pinball machine incorporating the panel of FIG. 10.

FIG. 13 illustrates the geometry of the panel 240 within the amusement game 20. The playfield 24 and the panel 240 form an angle α. The screen 52 of the CRT 50 and the panel 240 form an angle β. The screen 52 of the CRT 50 is spaced from the panel 240 by a distance P1 at the forward portion of the CRT 50 and by a distance P2 at the rear of the CRT 50. When an image is projected from the CRT 50 (or a image-forming device like a CRT 50), it travels a distance D1 before reaching the panel 240 when originating from the forward portion of the CRT 50 and a smaller distance D2 when originating from the rear of the CRT 50. The image from the CRT 50 that is incident on the panel 240 makes an angle ϕ with the panel 240. A resulting virtual image 250 produced by the reflection on the second portion 244 of the panel 240 is perceived by the player to be at the same distances and angles below the panel 240. In other words, the part of the image adjacent to the forward portion of the CRT 50 is perceived by the player to be at a distance D1 from panel 240 when proceeding along a line at angle ϕ with respect to the panel 240. Of course, the virtual image 250 is actually a reflection from the upper surface of the panel 240; it is just perceived by the player to be below the panel 240 as is the case with a typical mirror reflection. Consequently, it should be understood that it is the relative distances and angles between the CRT 50 and the panel 240, and between the panel 240 and the playfield 24 that dictate the location of the virtual image 250.

Because it is desirable to have the virtual image 250 at least at the top of the playfield 24, the angle α, the angle β, the distance P1, and the distance P2 should be properly selected. In many instances, it is desirable to have the image 250 intersect the playfield 24 such that a portion of the image 250 is perceived by the player to be positioned below the playfield 24. For example, the playfield 24 may have a cavity below its upper surface and the virtual image 250 can be created such that the player perceives that the image 250 is moving from this cavity onto the upper surface of the playfield 24. In one embodiment, the angle α between the playfield 24 and the panel 240 is about 10°. The angle β between the screen 52 of the CRT 50 and the panel 240 is about 45° to 50°. This preferred value of angle β is given as a range in part due to the slight curvature of the screen 52 of the CRT 50. The distances P1 and P2 between the screen 52 and the panel 240 are about 15 inches and 1.0 to 2.0 inches, respectively.

Further, the game 20 may include a motor 260 that is mechanically coupled to the CRT 50 such that the CRT 50 is movable. Unlike a stationary CRT which results in the player perceiving the virtual image 250 in one plane relative to the playfield 24, the motor 260 would provide a method of changing the plane in which the player perceives the virtual image 250. If the motor 260 is used, an image on the screen 52 can be kept at the same position of the screen 52 and when the entire CRT 50 (and screen 52) is moved, corresponding movement is produced in the virtual image 250. The motor 260 could be chosen to provide one or more of the following movements which are defined with reference to the coordinate system of FIG. 13 (X-direction is parallel to the plane of the screen 52, Y-direction is perpendicular to the screen 52): translational movement along the X-axis, translational movement along the Y-axis, translational movement along the Z-axis, rotational movement around the X-axis, rotational movement around the Y-axis, and rotational movement around the Z-axis. It should be noted that rotation around the Y-axis and translation along the Z-axis has no effect on the plane in which the virtual image 250 appears. However, either of these two movements will produce a corresponding movement in the virtual image 250. Also, while FIG. 13 only illustrates one motor 260, the game may include more than one motor to effectuate the desired movements.

While the movement of the plane of the virtual image 250 has been described through the use of the motor 260 controlling the CRT 50, the plane of the virtual image 250 can also be adjusted by placing a convex or concave lens 264 adjacent to the screen 52 of the CRT 50 and using a motor 266 to change the angular position of the lens relative to the screen 52 as shown in FIG. 13.

The game 20 has been designed for easy retrofitting. In other words, the playfield 24 can be readily removed and replaced with a retrofitable playfield. At the same time, the memory device storing the video images may be replaced to provide a new set of images to be displayed by the CRT 50. Because the new playfield may have playfield elements that extend closer to the panel 240 or an upper surface that is further away from the panel 240, the game 20 includes position-altering mounting brackets 270*a* and 270*b* for the CRT 50. Each mounting bracket 270 has a plurality of discrete positions that allows the screen 52 of the CRT 50 to be selectively adjusted in at least the Y-direction. Because the mounting brackets 270*a* and 270*b* are on either side of the CRT 50, it is also possible to mount the CRT, for example, in the third discrete position of bracket 270*a* while placing the CRT in the second discrete position of bracket 270*b*.

Consequently, the brackets 270 can change the angle β in addition to altering the Y-direction distance.

Figure 14:
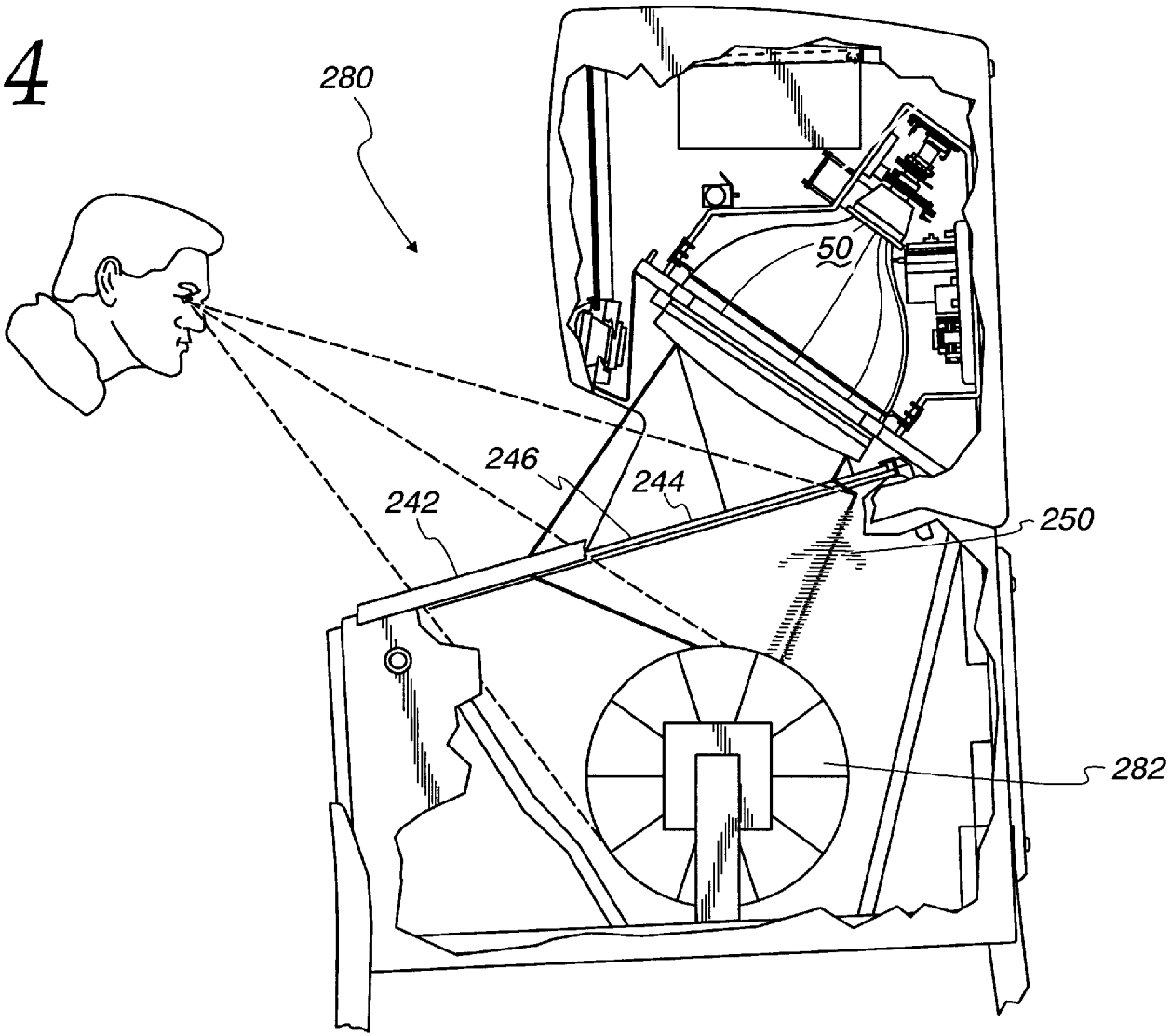
FIG. 14 is a side view of a gaming machine incorporating the panel of FIG. 10.
Figure 15:
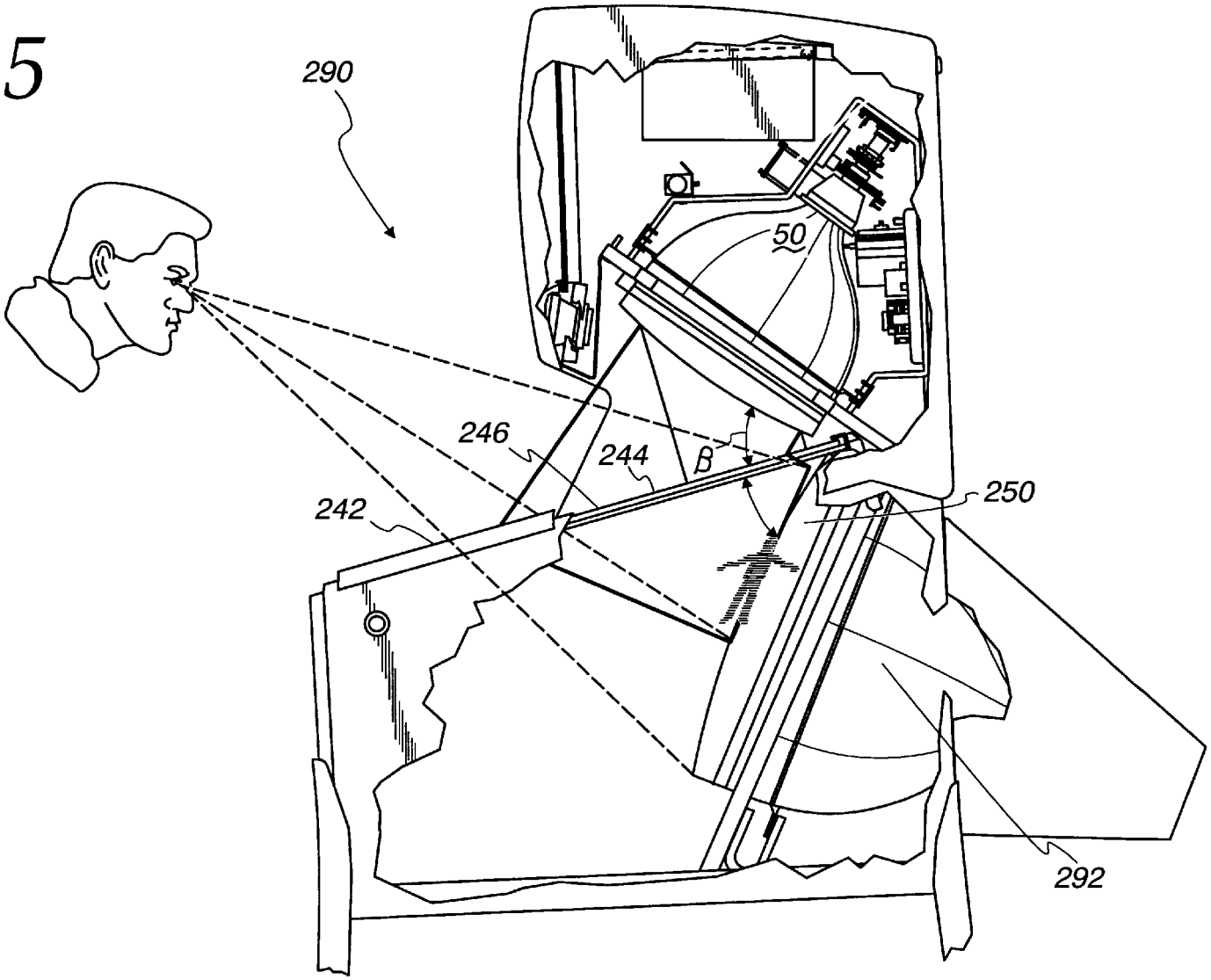
FIG. 15 is a side view of a video game incorporating the panel of FIG. 10.

While the invention has been described for use with the pinball game 20, using the panel 240 can be beneficial on pinball games that include video monitors as part of the play features. Additionally, the panel 240 has other applications as well. For example, in many gaming, machines such as the gaming machine 280 shown in FIG. 14, a player is betting on the outcome of the game in hopes of receiving a reward or a payout. The player is often focusing on various play devices within the machine. By using the variable reflective panel 240, the player can still visualize these play devices, but would also be perceiving virtual images relative to the play devices, which may be in the form of a rotating reel or reels 282 or a video monitor displaying information. The panel 240 is also beneficial when used in conjunction with video games 290 (FIG. 15) where, for example, the play devices are images projected by a video game CRT 292 that are viewed by the player. In this situation, the high-reflectance portion, the second portion 244 of the panel 240 in FIG. 10, may be positioned to provide virtual images associated with the images being projected by the videogame CRT 292 viewed by the player, while the low-reflectance portion is positioned so that a player's line of sight to another portion of the video game CRT 292 (e.g. the part of the CRT providing the score) is not interfered with.

Further, while desirable results have been achieved when the panel has the optically distinct regions, acceptable results can also be achieved by providing a constant gradient along the entire length of the panel. For example, the coating at the top region of the panel below the CRT may be applied to produce a reflectivity of about 30% to 40% and gradually change along the length to a point where no coating (or a slight coating) is present at the bottom region adjacent to the player such that the reflectivity in the bottom region is essentially the inherent reflectivity of the material of the panel (e.g. 5%). Similarly, while FIG. 11 illustrates generally constant reflectivities in the first and second portions 242, 244, each portion may have a reflectivity gradient as well. Also, it is possible to have a constant reflectivity along the length of the panel to produce a virtual image. However, a constantly high reflectivity (30%) along the panel will cause the player to partially visualize himself or herself (or even the ceiling) when the player focuses on the region of the playfield near the flippers. This, of course, inhibits the player's ability to see the rolling ball. And, if the reflectivity along the length of the panel is constant, yet low (e.g. 5% to 15%), then the virtual image produced by the CRT is not as sharp.

What has been illustrated and described herein is a novel amusement game wherein virtual images are projected in association with a playfield, in an interactive form with the play features and/or devices of the playfield. The amusement game may include various features for sensing the position of a ball on the playfield and for triggering various visual and audio affects. The playfield devices may include various devices for guiding or otherwise interacting with the ball, as well as various physical objects or figures upon which or in connection which the virtual video images may be projected. The projected images may also include other information such as scoring information, instructions for play of the game and the like.

What is claimed is:

1. An amusement game comprising:

a playfield having a plurality of play features;

a game piece movable relative to said playfield; and a panel for prohibiting access of a player to said playfield and said game piece, said panel including at least two optically distinct portions, a first optically distinct portion being substantially transparent for viewing a first region of said playfield, a second optically distinct portion being partially transparent for viewing a second region of said playfield and partially reflective for reflecting a virtual image to be viewed by said player, said second optically distinct portion having a higher reflectivity than said first optically distinct portion.

2. The amusement game of claim 1, wherein said first optically distinct portion has a reflectivity of about 5% to about 15%.

3. The amusement game of claim 1, wherein said second optically distinct portion has a reflectivity of about 30% to about 40%.

4. The amusement game of claim 1 wherein said panel is a unitary piece of material.

5. The amusement game of claim 1 wherein said panel is substantially planar.

6. The amusement game of claim 1 wherein said image is perceived by said player to be adjacent to said playfield.

7. The amusement game of claim 1 wherein said image is a three-dimensional image.

8. The amusement game of claim 1, wherein said game piece is a rolling ball and said virtual image is displayed in response to said ball acting upon at least one of said plurality of play features.

9. The amusement game of claim 1, further including a third optically distinct portion between said first and second portions, said third optically distinct portion having a reflectivity that is greater than said first portion and less than said second portion.

10. The amusement game of claim 9, wherein said third optically distinct portion has a varied reflectivity.

11. The amusement game of claim 10, wherein said third optically distinct portion has a reflectivity slightly greater than said reflectivity of said first portion adjacent to said first portion and a reflectivity slightly less than said reflectivity of said second portion adjacent to said second portion.

12. The amusement game of claim 11, wherein said reflectivity of said third portion gradually changes from said first optically distinct portion to said second optically distinct portion.

13. The amusement game of claim 12, wherein said first optically distinct portion has a reflectivity of about 5% and said second optically distinct portion has a reflectivity of about 35%.

14. The amusement game of claim 1, wherein said panel is a made of a unitary piece of glass and said second optically distinct portion includes a coating providing said reflectivity.

15. The amusement game of claim 14 wherein said coating is located on a surface of said glass exposed to said player.

16. The amusement game of claim 15, wherein said panel further includes markings to ensure the panel is installed correctly with said coating exposed to said player.

17. The amusement game of claim 1, further including a video monitor oriented to project an image onto said second optically distinct portion thereby creating said virtual image.

18. The amusement game of claim 17, further including means for adjusting the location of said virtual image relative to said playfield.

19. The amusement game of claim 18, wherein said adjusting means includes a motor.

20. A game comprising:

a plurality of play devices;

a panel for prohibiting access of a player to said plurality of play devices and including at least two optically distinct portions, a first optically distinct portion being substantially transparent for viewing at least one of said play devices, a second optically distinct portion being partially transparent for viewing at least another of said plurality of said play devices and partially reflective for reflecting a virtual image perceived by the player to be in association with at least one of said plurality of play devices, said second optically distinct portion having a higher reflectivity than said first optically distinct portion.

21. The game of claim 20, wherein said first optically distinct portion has a reflectivity of about 5% to about 15%.

22. The game of claim 20, wherein said second optically distinct portion has a reflectivity of about 30% to about 40%.

23. The game of claim 20, wherein said panel further includes a third optically distinct portion between said first and second portions, said third optically distinct portion having a reflectivity that is greater than said first portion and less than said second portion.

24. The game of claim 23, wherein said reflectivity of said third portion gradually changes from said first optically distinct portion to said second optically distinct portion.

25. The game of claim 20, wherein said game is a pinball machine and said plurality of play devices includes a playfield having a plurality of play features.

26. The game of claim 20, wherein said game is a video game and said plurality of play devices are play images created by a video monitor.

27. The game of claim 20, wherein said game is a gaming machine.

28. The game of claim 20, further including a video monitor oriented to project an image onto said second optically distinct portion thereby creating said virtual image.

29. The amusement game of claim 28, further including means for adjusting the location of said virtual image relative to said playfield.

30. A game comprising:

a cabinet having a plurality of side walls at least one of which defines an opening into an interior of said cabinet;

a plurality of play devices to be viewed by a player, said plurality of play devices being located within said interior of said cabinet; and a panel covering said opening to enclose said interior, said panel having at least a low reflective portion and a high reflective portion, said high reflective portion for creating a virtual image in association with at least one of said plurality of play devices.

31. The game of claim 30, wherein said game is a pinball machine and said plurality of play devices includes a playfield having a plurality of play features.

32. The game of claim 30, wherein said game is a video game and said plurality of play devices are play images created by a video monitor.

33. The game of claim 30, wherein said game is a gaming machine.

34. The game of claim 30, further including a video display for displaying said image that is reflected by said highly reflective portion and viewed by a player as a virtual image.

35. The game of claim 34 wherein said virtual image is perceived by a player to be a three-dimensional image.

36. The game of claim 30 wherein said panel is made from a unitary piece of material.

37. The game of claim 36, further including a third optically distinct portion between said high and low reflective portions, said third optically distinct portion having a reflectivity that is greater than said low reflective portion and less than said high reflective portion.

38. The game of claim 37, wherein said third optically distinct portion has a varied reflectivity.

39. The game of claim 30, further including means for adjusting the position of the virtual image relative to at least one of said plurality of play devices.

40. An amusement game comprising:

a playfield having a plurality of play features;

a source of video information;

a video display;

a controller coupled to said source of video information and to said video display for selecting video information from said source to be displayed upon said video display; and a panel at least partially overlaying said playfield and including a partially reflective portion and a substantially transparent portion, said partially reflective portion of said panel and said video display being relatively positioned for creating a virtual image which is perceived by a player to be adjacent to said playfield.

41. The game of claim 40, wherein, from a side view, said partially reflective portion of said panel is generally in a first plane and said video display is generally in a second plane, said first and second planes intersecting at an angle of about 45° to 50°.

42. The game of claim 41, wherein said playfield is generally in a third plane, said first and said third planes intersecting at a second angle of about 10°.

43. The game of claim 40, further including means for adjusting the relative position of said video display to said partially reflective portion of said panel.

44. The game of claim 43, wherein said adjusting means includes a motor.

45. The game of claim 44, wherein said adjusting means includes a lens adjacent to said video display.

46. The game of claim 44, wherein, from a side view, said partially reflective portion of said panel is generally in a first plane and said video display is generally in a second plane, said first and second planes intersecting at an angle, said motor adjusting said angle.

47. The game of claim 44, wherein said partially reflective portion of said panel and said playfield are spaced from each other by a distance, said motor adjusting said distance.

48. The game of claim 44, wherein said partially reflective portion of said panel has an axis perpendicular thereto and extending outwardly therefrom, said motor adjusting said video display relative to said axis.

49. The game of claim 40, wherein said virtual image is perceived by said player to intersect with said playfield such that a portion of said virtual image is perceived to be below said playfield.

50. The game of claim 40, wherein said virtual images comprise three-dimensional images.

51. The game of claim 40 further including means for fixing the relative mounting position between said video monitor and said reflective portion of said panel.

52. The game of claim 51 wherein said fixing means includes at least one mounting bracket having within a plurality discrete mounting positions.

53. The game of claim 52 wherein said fixing means includes two mounting brackets, one of said two mounting brackets being on one side of said video monitor, the other of said two mounting brackets being on another side of said video monitor.

54. The game of claim 51 wherein said fixing means establishes the angular position of said video monitor relative to said reflective portion of said panel.

55. The game of claim 51 wherein said fixing means establishes the spacing between said video monitor and said reflective portion of said panel.

56. An amusement game comprising:

a playfield having a plurality of play features;

a game piece movable relative to said playfield; and a panel for prohibiting access of a player to said playfield and said game piece, said panel having a variable optical reflectivity along the length of the panel, said panel allowing said player to view a region of said playfield and a virtual image that appears to said player to be adjacent to said region.

* * * * *